United States Patent [19]

Haertl

[11] Patent Number: 4,476,353

[45] Date of Patent: Oct. 9, 1984

[54] HEARING AID DEVICE TO BE WORN IN THE EAR

[75] Inventor: Christof Haertl, Neunkirchen am Brand, Fed. Rep. of Germany

[73] Assignee: Siemens Aktiengesellschaft, Berlin and Munich, Fed. Rep. of Germany

[21] Appl. No.: 350,577

[22] Filed: Feb. 22, 1982

[30] Foreign Application Priority Data

Mar. 11, 1981 [DE] Fed. Rep. of Germany ... 8106942[U]

[51] Int. Cl.[3] ..... H04R 25/02

[52] U.S. Cl. ..... 179/107 E

[58] Field of Search ..... 179/107 E, 179, 107 H

[56] References Cited

U.S. PATENT DOCUMENTS

| | | | |
|---|---|---|---|
| 3,470,328 | 9/1969 | Daniels | 179/107 E |
| 3,496,306 | 2/1970 | Pollack | 179/107 E |
| 3,598,928 | 8/1971 | Hickox | 179/107 E |
| 3,852,540 | 12/1975 | Diethelm | 179/107 E |

FOREIGN PATENT DOCUMENTS

| | | | |
|---|---|---|---|
| 1270616 | 8/1966 | Fed. Rep. of Germany | 179/107 E |
| 1274657 | 8/1968 | Fed. Rep. of Germany | 179/107 E |
| 1173657 | 12/1967 | United Kingdom | 179/107 E |

*Primary Examiner*—Gene Z. Rubinson
*Assistant Examiner*—L. C. Schroeder
*Attorney, Agent, or Firm*—Hill, Van Santen, Steadman & Simpson

[57] ABSTRACT

In an exemplary embodiment, a first shell has the contours of an individually fitted ear adapter and the second shell has a carrier plate penetrated by openings for adjustment elements of the hearing aid structure. In known devices, the covering of the cavity of the ear adapter has proven unfavorable both cosmetically as well as mechanically. In order to alleviate this, the disclosure provides that the inside space of a cover plate be provided with an internally disposed cavity for the carrier plate whose outside dimensions are smaller than the smallest dimensions to be expected for an individually fitted ear adapter, and that the second shell is significantly larger, so that, after application to the first shell, laterally projecting parts are cut off. The disclosed structure is particularly suited for employment given in-ear hearing aids.

5 Claims, 5 Drawing Figures

HEARING AID DEVICE TO BE WORN IN THE EAR

BACKGROUND OF THE INVENTION

The invention relates to a hearing aid device to be worn in the ear comprising a housing consisting of two shells of which the first has the outer contours of an individually fitted ear adapter and the second, whose floor is penetrated by access openings and adjustment elements of the operating elements of the hearing aid structure, is attached to the open side of the first shell for closing it.

Given in-ear hearing aids of the "custom-made version", i.e., such as have an at least largely prefabricated device which is inserted into a fitted ear adapter, it has proven expedient to design the prefabricated part of the device as an assembly unit so as to be easily interchangeable. To that end, the actual installation space should be situated in the cavity of a fitted ear adapter which is covered with a closing plate that exhibits an opening in its center into which an assembly unit is inserted which carries the operating elements (volume control, matching regulator, switch, microphone, battery compartment). Since, however, the assembly unit to be employed must be a matter of an element suitable for all dimensions occurring in the care of hearing-impaired persons, a lateral edge always remains in the cover plate upon insertion, said lateral edge being perceptible on the finished device. However, an inconspicuous structure is preferred for a hearing aid; i.e., for cosmetic reasons, the assembly unit should not be visible on the device. Moreover, given small dimensions of the ear, only a narrow ring of the cover plate remains, its stability being only slight for the support of the assembly unit.

SUMMARY OF THE INVENTION

Given a hearing aid to be worn in the ear according to the preamble of claim 1, the object of the invention is to provide a housing in which the covering of the cavity of the ear adapter is more favorable both cosmetically as well as mechanically. This object is inventively achieved by means of the measures cited in the characterizing part of claim 1.

By means of employing a housing consisting of two shells of which the first shell is a hollow fitted ear adapter and the second shell is in the form of a recessed plate providing an interior space or cavity which can be equipped with operating elements, there derives the advantage that no inserted assembly unit is visible from the outside and that, on the other hand, a stable covering is retained in the form of the recessed plate even when the non-recessed peripheral edge which is employed for the connection becomes narrow. The remaining non-recessed peripheral edge outwardly of the recessed portion always represents a stiffening frame for that part of the cover plate extending over the entire surface. It has proven expedient to give the plate an outer dimension, for example a diameter of 50 mm, which at least suffices to cover the opening of the hollowed ear adapter up to the outer edge of the walls limiting it even for the largest fitted form, and to give the recessed plate a cavity of a maximum extent which yet fits into that of the first shell with a substantial clearance even given the smallest fitting to be expected, and that, after the two shells have been applied to one another, parts of the non-recessed plate-shaped edge of the second shell which may project laterally are cut off.

The materials standard in the manufacture of in-ear hearing aids are suitable for the manufacture of the shells of which the housing consists. From the multitude of synthetic materials resistant to the demands to be expected in the above sense, polyacetyl resin or acrylic resin, for example, polymethylmethacrylate, can, for example, be employed for the first shell. The minimum thicknesses of the walls to be observed for the shells derive after selection of the material to be employed for the stability to be observed. Given employment of the aforementioned polyacetyl resin, the thickness of the wall of the ear adapter should not fall below 0.7 mm. Polyvinylpropionate could, for example, be employed for the second plate., thereby, a thickness in the magnitude of 1.6 mm should be present at the non-recessed peripheral edge, whereby the cavity should not fall below a depth of 1.2 mm. The materials of the shells of the housing are to be selected in such manner that they can be connected, for instance, bonded, etc., to one another.

For the insertion of the operating elements of the hearing aid into the cavity of the second shell of the housing, it has been shown that it is favorable to attach these together with the microphone and the battery support on a carrier and to lend both the carrier and the cavity a matched shape. Since, according to the invention, this shape remains externally invisible, it can be largely adapted to the physiological shapes of the ear orifice. In this sense, a triangular carrier plate represents an expedient shape, the corners of said triangular carrier plate being rounded off and said carrier plate fitting into a cavity of the second shell which corresponds to this shape. The manufacture of a hearing aid equipped with an inventive housing can ensue in such manner that, first, a hollow ear adapter corresponding to an impression of the ear to be serviced is manufactured as the first shell;

in that a receiver earpiece which lies at the amplifier via a line is inserted into said shell and is acoustically connected to the sound trumpet;

that the assembly unit of the operating elements (volume control, matching regulator, switch, microphone, battery compartment) which lie on a carrier plate and are connected to the amplifier via a line are inserted with this carrier plate into the cavity of the second shell;

that the second shell is attached over the opening of the first shell; and that, if need be, parts of the edge of the second shell projecting beyond the edge of the first shell are cut off.

In the following, further details and advantages of the invention are explained in greater detail on the basis of exemplary embodiments illustrated in the Figures on the accompanying drawing sheet; and other objects, features and advantages will be apparent from this detailed disclosure and from the appended claims.

DETAILED DESCRIPTION

Figure 1:
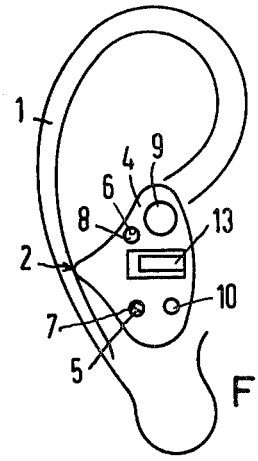
FIG. 1 shows a view of an ear in which an inventively equipped in-ear hearing aid is inserted.
Figure 3:
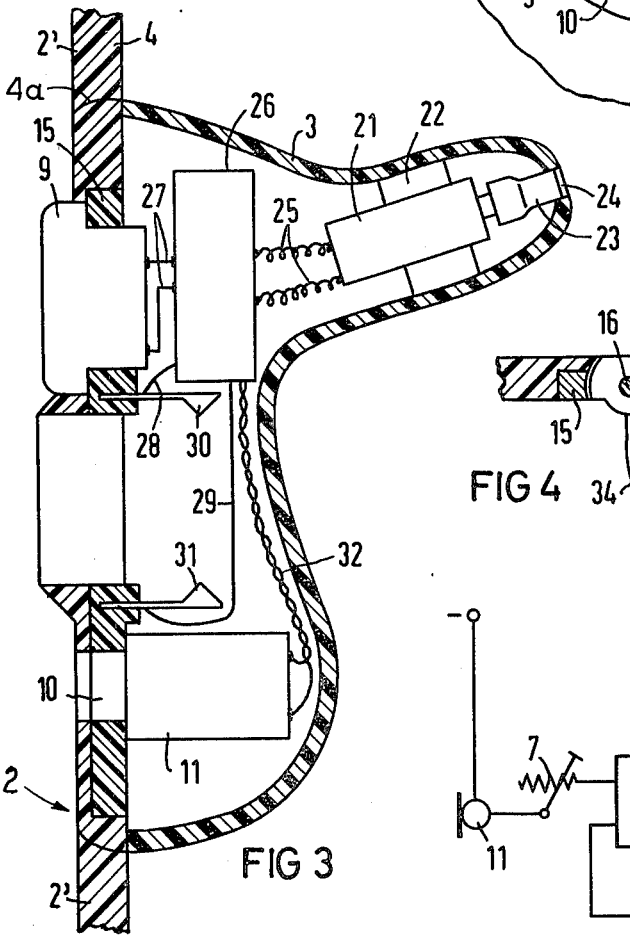
FIG. 3 shows a section through the device illustrated in FIGS. 1 and 2 and taken along the line III—III in FIG. 2., however without an inserted battery holder.

In FIG. 1, 1 indicates an ear into which an in-ear hearing aid referenced with 2 is inserted with its first shell 3 (FIG. 3) which is not visible in this Figure. The part visible in FIG. 1 is the outer surface of a second shell 4 attached to the first shell. Visible in FIG. 1 are regulators 7 and 8 accessible through openings 5 and 6 as well as a setting element 9 for a volume control and an opening 10 through which the sound can proceed to a microphone 11 (FIG. 3). Finally, the outside of a battery holder 13 is visible at the outer surface of the second shell.

Figure 2:
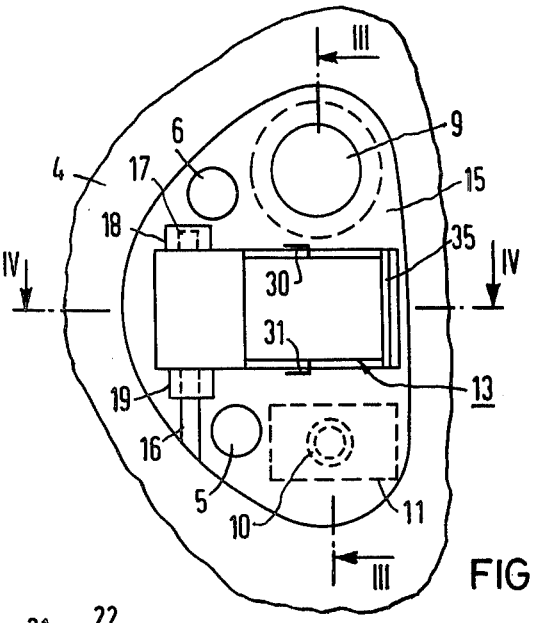
FIG. 2 shows an enlarged illustration of an inside view of the cover plate with inserted assembly unit.

Visible from an inside view of an assembly or carrier plate 15 and of the second shell 4 illustrated in FIG. 2 are the passages 5 and 6 for the regulators 7 and 8, as well as the volume control element 9 and the sound inlet opening 10 for a microphone 11, components 10 and 11 being indicated with broken lines. The battery holder 13 is secured to the assembly plate 15 by means of a plug-in axle 16. Thereby, the axle 16 is rotatably seated in a through-bore 17 of bosses 18 and 19 which are located at opposite sides of the opening for the battery holder 13. The support of the axle 16 against axial displacement ensues on the one hand by means of the only partial, i.e., dead-end hole, formed by bore 17 in the boss 18 and, and, on the other hand, by means of the lateral blocking of axial displacement of the axle 16 deriving upon insertion of the plate 15 into the recess of the shell 2. The plate 15 has a triangular shape, wherein the corners have been rounded off. It has thereby derived as being expedient to provide a length dimension for each side of the triangle of somewhat less than 20 mm and a height of approximately 12 mm given the shape of an equilateral triangle.

In the overall illustration shown in section in FIG. 3, the battery holder 13 has been omitted for reasons of clarity. Visible, however, is the first shell 3 externally fitted as an ear adapter for the hearing-impaired person to be supplied with a hearing aid, in which first shell 3 an earpiece receiver 21 is inserted at soft-cushioning parts 22, being connected via an elastic tube 23 to a sound trumped 24. At the other side, the receiver 21 is connected via lines 25 to an amplifier 26 which at its other side exhibits a connection via the lines 27 to the volume regulator 9, via lines 28 and 29 to battery contact springs 30 and 31, as well as a connection via a multiple line 32 to the microphone 11. It can be seen in FIG. 3 that the second shell 4 exhibits a larger diameter per se, i.e., a diameter of 50 mm, of which the projecting edge 2' is cut off to form a margin as indicated at 4*a* after attachment of the second shell 4 to the first shell 3.

Figure 4:
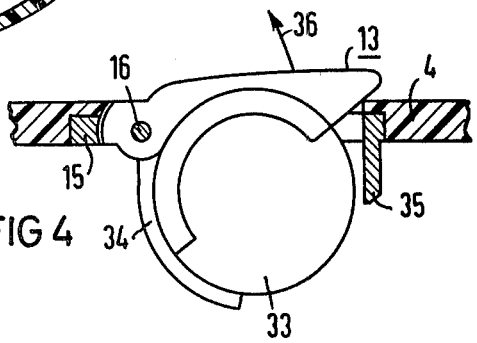
FIG. 4 shows a section through the battery holder taken along the line IV—IV of FIG. 2.

The battery holder 13 can be seen in FIG. 4, said battery holder 13 fixing a battery 33 in a support mount 34 partially encompassing the battery 33. A retainer 35 prevents the battery 33 from falling out of the holder in the operating position. When the battery holder 13 is hinged out, the battery 33 can be removed and replaced.

Figure 5:
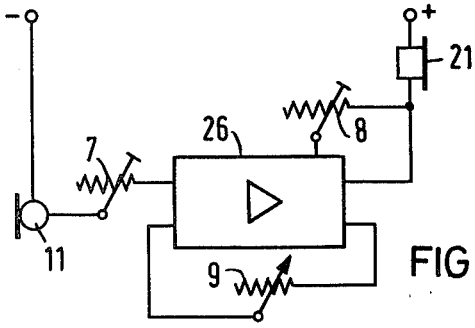
FIG. 5 shows a schematic block diagram of the device structure employed according to the preceding Figures.

The manner of functioning which coincides per se with that of standard hearing aids is illustrated in FIG. 5 on the basis of a schematic block diagram. The pickup of sound signals ensues in the microphone 11; from there, the microphone signal proceeds via the volume limiting control 7 to the amplifier 26. In the ratio of the resistance set at 7 to the input resistance of the amplifier, the microphone signal is thereby adjusted down so that—in case necessary—the maximum range of control of the volume control 9 is also available even given low amplification.

The output signal arriving at the earpiece receiver 21 is regulated by means of the regulator 8 in such manner that an upper limit of the amplified volume cannot be exceeded. This ensues by means of inverse feedback from the collector of the output stage to the base via the non-linear characteristic of anti-parallel diodes. When the threshold voltage of the diodes is exceeded, then the output signal is reduced. By so doing, one obtains a delay-free back-coupling and a protection against too high an output sound volume. The actual volume control ensues via the regulator 9 which is connected to the amplifier in the standard manner.

It will be apparent that many modifications and variations may be effected without departing from the scope of the novel concepts and teachings of the present invention.

I claim as my invention:

1. A hearing aid to be worn in the ear comprising a housing which is formed of first and second shells, the first shell having outside contours of an individually fitted ear adapter and having a wall configuration with an outer edge at an open side thereof; and the second shell having separate carrier means penetrated by access openings, having a microphone and a battery holder, and having operating elements of an operating hearing aid circuit at said access openings, said second shell being attached at the open side of the first shell so as to close the first shell; an earpiece receiver in a cushioned support mount in the first shell; the second shell being in the form of a cover plate, said cover plate being secured with said first shell and having a recess which opens toward said first shell; said carrier means comprising a unitary carrier plate receiving the microphone, the battery holder and the operating elements, and being disposed in said recess of said cover plate; said unitary carrier plate having the same shape as said recess; said cover plate having an outside surface with a dimension which at least suffices to cover the first shell up to the outer edge of the wall configuration of the first shell, even for the largest fitted dimension of the first shell; and the recess of the cover plate having maximum dimensions which fit within the open side of the first shell given the smallest outside contours of the first shell to be expected; and the cover plate having a plate-shaped edge forming a perimeter of the second shell which may be cut off so as to conform with the perimeter at the open side of the first shell.

2. A hearing aid according to claim 1, characterized in that the carrier plate is generally triangular in shape with rounded-off corners and has a thickness of approximately $\frac{3}{4}$ of the plate-shaped edge of the cover plate, the thickness of the carrier plate at least corresponding to the depth of the recess.

3. A hearing aid according to claim 1, characterized in that the two shells are connected to one another by means of bonding.

4. A method for manufacturing a hearing aid to be worn in the ear, characterized by manufacture of a hollow ear adapter as a first shell according to an impression of the ear to be serviced; insertion of an earpiece receiver into a cushioned support mount in the first shell and of a hearing aid circuit to which the earpiece receiver is connected via lines; insertion of operating elements into a recess of a second shell, whereby a connection of the operating elements is present to the hearing aid circuit via lines; attachment of the equipped second shell to the opening of the first shell; and separation of the parts of the edge of the second shell which project beyond the first shell.

5. A hearing aid according to claim 1, characterized in that the carrier plate has a receiving space for accomodating the battery holder and has a blind bore with closed end at one side of the receiving space and a through bore extending from an outer margin of the carrier plate up to the receiving space at the other side thereof, the battery holder comprising a pivotable compartment having an axle bore and having an axle seated in the axle bore, and in the blind bore and the through bore of the carrier plate, the axle being inserted from the through bore through the axle bore of the pivotable compartment into the blind bore of the carrier plate and having a length which extends from the closed end of the blind bore up to the outer margin of the carrier plate so that the axle is fixed axially upon insertion of the carrier plate into the recess means of the cover plate.

* * * * *